US012000246B2

(12) United States Patent
Tønnessen et al.

(10) Patent No.: US 12,000,246 B2
(45) Date of Patent: Jun. 4, 2024

(54) METHOD FOR EVACUATING HYDROCARBON FROM A SUBSEA PROCESS MODULE

(71) Applicant: FMC Kongsberg Subsea AS, Kongsberg (NO)

(72) Inventors: Leif Arne Tønnessen, Bærums Verk (NO); Lachlan McKenzie, Røyken (NO)

( * ) Notice: Subject to any disclaimer, the term of this patent is extended or adjusted under 35 U.S.C. 154(b) by 100 days.

(21) Appl. No.: 17/924,328

(22) PCT Filed: May 7, 2021

(86) PCT No.: PCT/EP2021/062177
§ 371 (c)(1),
(2) Date: Nov. 9, 2022

(87) PCT Pub. No.: WO2021/228719
PCT Pub. Date: Nov. 18, 2021

(65) Prior Publication Data

US 2023/0175356 A1 Jun. 8, 2023

(30) Foreign Application Priority Data

May 11, 2020 (NO) ..... 20200555

(51) Int. Cl.
*E21B 43/01* (2006.01)

(52) U.S. Cl.
CPC ..... *E21B 43/01* (2013.01)

(58) Field of Classification Search
CPC ..... E21B 43/01; E21B 41/00
See application file for complete search history.

(56) References Cited

U.S. PATENT DOCUMENTS

| | | | | |
|---|---|---|---|---|
| 9,797,223 | B1 | 10/2017 | Gordon | |
| 10,683,736 | B2 * | 6/2020 | Chen | E21B 43/168 |
| 2015/0361769 | A1 | 12/2015 | Williams et al. | |
| 2018/0298711 | A1 | 10/2018 | Skeels et al. | |
| 2019/0186673 | A1 | 6/2019 | Martinsen et al. | |
| 2019/0374979 | A1 | 12/2019 | Brenne et al. | |

FOREIGN PATENT DOCUMENTS

| | | | |
|---|---|---|---|
| WO | WO 2009/155461 | A1 | 12/2009 |
| WO | WO 2019/045574 | A1 | 3/2019 |

* cited by examiner

*Primary Examiner* — Timothy L Maust

(57) ABSTRACT

Method for evacuating hydrocarbon from a subsea process module (210), the subsea process module having an upper fluid connection point (222) and a lower fluid connection point (232), the method comprising: connecting (110) a receiving container line (220) to the upper fluid connection point (222) of the subsea process module (210); connecting (120) a liquid adding line (230) to the lower fluid connection point (232) of the subsea process module (210); displacing (130) hydrocarbon by a liquid displacement medium added through the liquid adding line (230); removing (140) the liquid adding line from the lower fluid connection point (232); connecting (150) a gas adding line (260) to either the upper fluid connection point (222) or a lower fluid connection point (232); connecting (160) a receiving container line (220) to the lower fluid connection point (232) and or another lower fluid connection point; diluting (170) the remaining hydrocarbon by a gas medium added through the gas adding line (260).

13 Claims, 8 Drawing Sheets

METHOD FOR EVACUATING HYDROCARBON FROM A SUBSEA PROCESS MODULE

TECHNICAL FIELD

The invention relates to a method for evacuating hydrocarbon from a subsea process module, such as a compressor.

BACKGROUND

An essential activity in subsea oil and gas operations is the retrieval of subsea equipment, including subsea process modules, such as compressors, from a subsea location. The retrieval of a subsea process module may for instance be necessary due to routine maintenance, repair, or replacement of the subsea process module.

When a subsea process module is retrieved and brought to a topside/surface location, for instance to a deck of an intervention vessel, it is crucial that the process module does not contain any residual hydrocarbon, since such residual hydrocarbon may represent a safety risk. In case residual hydrocarbons cannot be avoided, very strict safety measures must be incorporated onboard the vessel, for example a need for a flaring system dedicated to burn remaining hydrocarbons on deck.

Normally, the removal of hydrocarbons from a subsea process module before its retrieval is performed by a displacement method. High density monoethylene glycol, MEG, is injected into the subsea process module at a lower section of the module. This causes the hydrocarbon contained in the module, which has a lower density than the MEG, to be evacuated through an evacuation line at an upper section of the module.

However, this method has certain drawbacks, as any high-pockets will trap hydrocarbons with lower density than MEG, and this trapped hydrocarbon cannot be displaced.

It is an objective of the invention to provide a solution where the risk of trapped hydrocarbon gas, liquid or condensate in a subsea process module that is to be retrieved, is minimized.

SUMMARY OF THE INVENTION

There is a need for an improved method for evacuating hydrocarbon, HC, containing gas from a subsea process module.

The invention has been defined in the appended claims.

It is described a method for evacuating hydrocarbon from a subsea process module, the subsea process module having an upper fluid connection point and a lower fluid connection point, the method comprising:

- connecting a receiving container line to the upper fluid connection point of the subsea process module;
- connecting a liquid adding line to the lower fluid connection point of the subsea process module;
- displacing hydrocarbon by a liquid displacement medium added through the liquid adding line;
- removing the liquid adding line from the lower fluid connection point;
- connecting a gas adding line to either the upper fluid connection point or the lower fluid connection point;
- connecting a receiving container line to the lower fluid connection point and or another lower fluid connection point;
- diluting the remaining hydrocarbon by a gas medium added through the gas adding line by diluting a gas-phase portion of the hydrocarbon that has been trapped in a pocket in the subsea process module.

In one embodiment, the gas adding line is connected to the upper fluid connection point and the receiving container line is connected to the same lower fluid connection point as the one used for connecting the liquid adding line.

In another embodiment, the gas adding line is connected to the upper fluid connection point and the receiving container line is connected to another lower fluid connection point than the one used for connecting the liquid adding line.

In yet another embodiment, the gas adding line is connected to the same lower fluid connection point as the one used for connecting the liquid adding line and the receiving container line is connected to another lower fluid connection point than the one used for connecting the liquid adding line.

In yet another embodiment, the gas adding line is connected to another lower fluid connection point than the one used for connecting the liquid adding line and the receiving container line is connected to the same lower fluid connection point as the one used for connecting the liquid adding line.

The subsea process module can be a subsea compressor module. Alternatively, the subsea process module may be any other hydrocarbon-carrying subsea module of complex internal geometry with high or low points, i.e. un-vented pockets which may be filled with hydrocarbon.

The liquid displacement medium may be a high-density liquid medium.

The high-density liquid medium may include monoethylene glycol, MEG.

The gas medium is preferably a non hazardous gas medium which is harmless to people. In addition, the gas medium shall be environmental friendly, i.e. it is non-explosive and may be vented to air. The gas medium may be nitrogen, $N_2$.

The step of displacing the hydrocarbon may include displacing a liquid-phase portion of the hydrocarbon including condensate and hydrocarbon gas (compressed hydrocarbon gas may be in liquid state when particular conditions relating to pressure, volume and temperature are present).

The displacing step may include transferring fluid from the subsea process module to an external container via the receiving container line.

The external container may be a flow conditioning unit, FCU. However, the external container can alternatively be any form of available volume, such as, in addition to an FCU, a separator, a manifold, a spool or a flowline. There may be one or a plurality of external containers. The external container may thus be present as a part of the subsea infrastructure and normally have another function, or the external container may be lowered for the single purpose of receiving and storing (permanent or temporary) the HC contents of the subsea process module.

The displacing step may be continued until a first predetermined condition is met. The first predetermined condition may be met when a measured amount of liquid displacement medium exceeds a predetermined level limit.

The predetermined level limit could correspond to a transferred/displaced volume larger than the largest possible volume of liquid in process module, and hence ensuring that all hydrocarbon liquids are displaced.

The displacing step may include transferring fluid from the subsea process module to an external container, and the first predefined condition is met when a liquid level in the external container exceeds a predetermined level limit.

In other words, the displaced volume of hydrocarbon to the external container can be measured either by:

1) measuring a liquid level increase in the external container using a liquid level sensor, or
2) measuring the amount of added displacement fluid (e.g. MEG) by using e.g. a flow meter in the supply system. When the added amount is larger than the volume of the process volume, one knows that the hydrocarbon (gas and condensate) within the whole volume of the process module (except non-ventilated high-points) has been displaced.

The diluting step may be continued until a second predetermined condition is met. The second predetermined condition may, e.g. be fulfilled when all liquid, other than liquid trapped in low points, is displaced to external container. Any remaining liquid trapped in low points may be residuals from the liquid displacement medium (e.g. MEG) used in displacing the hydrocarbons. These possibly remaining liquids are non-hazardous and safe to retrieve to surface while trapped or present in the subsea process module.

The method may further comprise, subsequent to the diluting step;

retrieving the subsea process module from a subsea location.

These and other characteristics of the invention will be apparent from the enclosed drawings, wherein;

DETAILED DESCRIPTION

Figure 1:
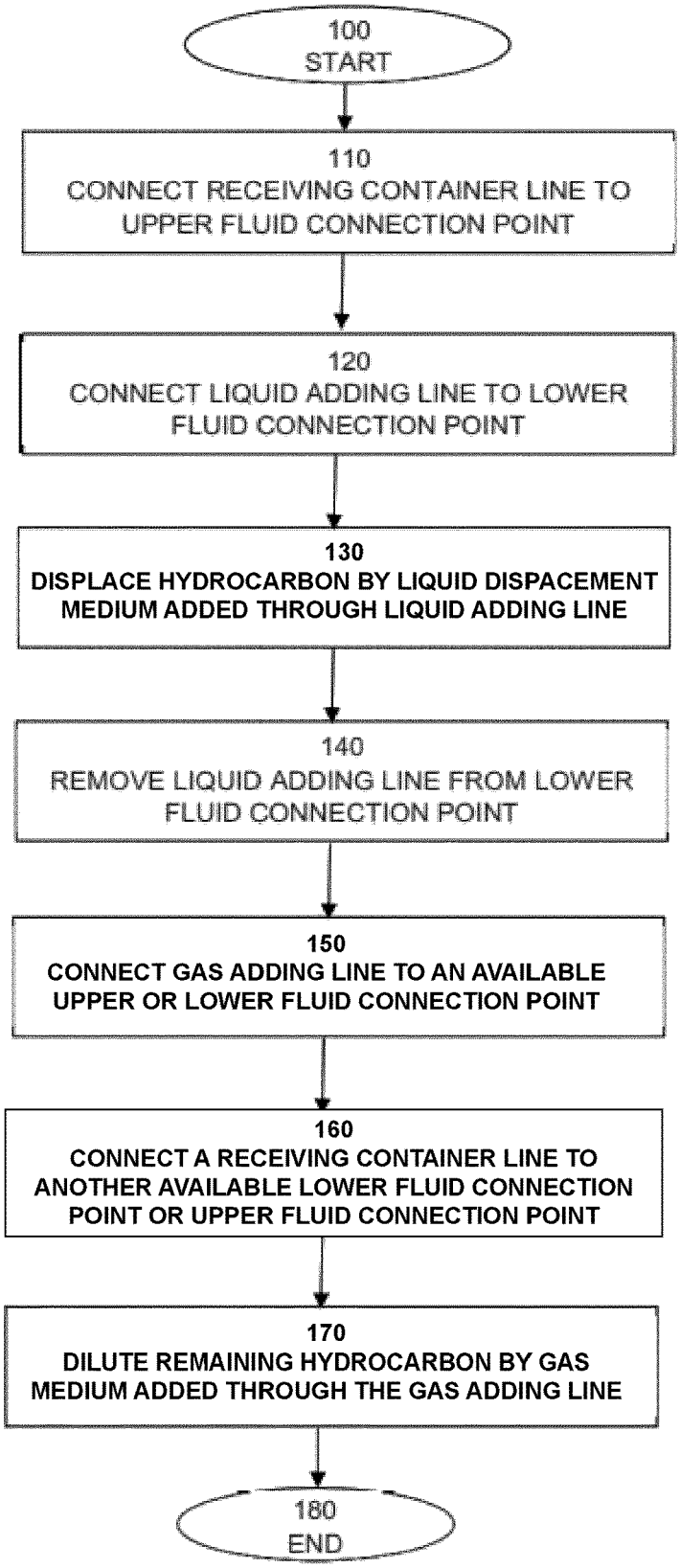
FIG. 1 is a schematic flow chart illustrating principles of a method for evacuating hydrocarbon containing gas from a subsea process module.

In the following, embodiments of the invention will be discussed in more detail with reference to the appended drawings. It should be understood, however, that the drawings are not intended to limit the invention to the subject-matter depicted in the drawings.

FIG. 1 is a schematic flow chart illustrating principles of method steps 100-180 for evacuating hydrocarbon containing gas from a subsea process module 210.

Figure 2:
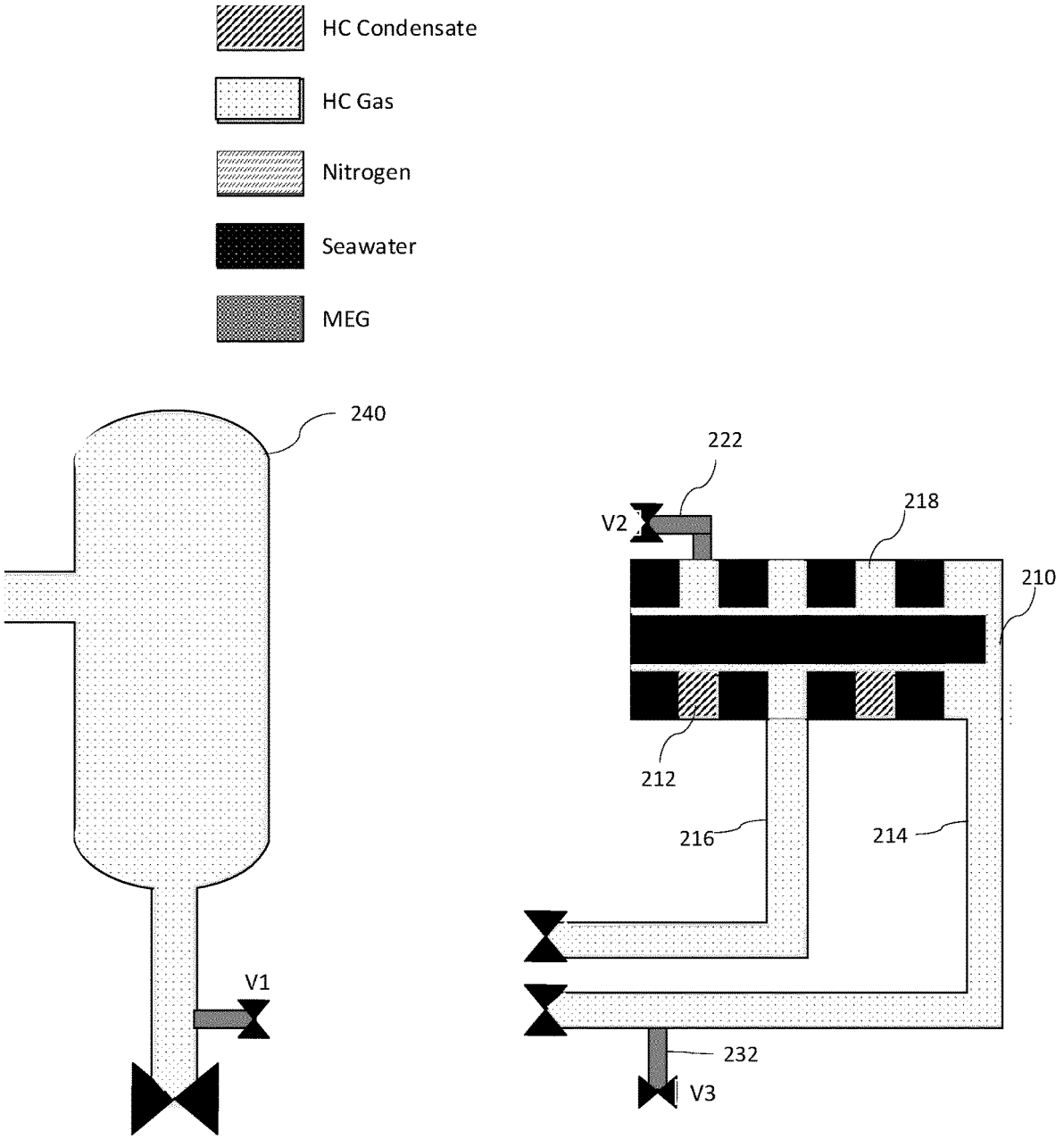
FIG. 2 is a schematic diagram illustrating principles of a subsea process module from which hydrocarbon is to be evacuated, and an external container.

Referring to FIG. 2, the subsea process module 210 has an upper fluid connection point 222 and a lower fluid connection point 232.

The method is particularly useful if the subsea process module 210 has a complex internal geometry, especially if the subsea process module 210 includes pockets or traps that may confine volumes of liquid and/or gas which are not readily removable by a regular liquid displacement method.

The subsea process module 210 may advantageously be a subsea compressor module, i.e., a compressor designed for compressing hydrocarbon gas. Each diffusor of a horizontally mounted centrifugal compressor will constitute both a low-point and a high-point and displacing or dilution of hydrocarbons to a safe HC-concentration is difficult or impossible with prior art methods. Alternatively, the subsea process module 210 may be any other hydrocarbon-carrying subsea module of complex internal geometry with high or low unvented pockets.

The method starts at the initiating step 100. Advantageously, the initial step 100 is being prepared by gravity-drainage of all hydrocarbon liquids in process module 210 (except liquid which is trapped in low-point pockets) to an external container 240 or any other suitable volume in the system. This can be facilitated by existing pipework and valves or by connecting hose(s) or lines for the desired purpose. The situation at the initiating step 100 is illustrated in FIG. 2, which illustrates a subsea process module 210 from which hydrocarbon is to be evacuated, and an external container 240. The subsea process module 210 may e.g. be a compressor. The container 240 may be a separator, slug damper, manifold, or any other volume external to process module 210. The subsea process module 210 has at least one pocket or trap 212 or 218 that may confine a volume of hydrocarbons, which is not readily removable by regular displacement or dilution methods. As illustrated by example, the pocket 212 is a recess, or cavity directed downwards, that may trap liquid such as a hydrocarbon condensate, preventing it from being drained out of the process module's low-point prior to a dilution process of the remaining hydrocarbon gas in the module. The pocket 218 is a recess, or cavity, directed upwards, that may trap fluids (condensate, gas) with lower density than the medium used for displacement (usually Monoethylene glycol (MEG)), preventing it from being displaced out of the module's high point.

In step 110, a receiving container line 220 is connected to the upper fluid connection point 222 of the subsea process module 210. In particular, a first end of the receiving container line 220 is connected to a valve, denoted V2, at the upper fluid connection point 222 of the subsea process module 210. A second end of the receiving container line is connected to an external container 240, in particular to a valve denoted V1, advantageously at a lower portion of the external container 240. Advantageously, the external container 240 is a flow conditioning unit, FCU.

Next, in step 120, a liquid adding line 230 is connected to the lower fluid connection point 232 of the subsea process module 210. In particular, a first end of the liquid adding line 230 is connected to a valve, denoted V3, at the lower fluid connection point 232 of the subsea process module 210. A second end of the liquid adding line 230 is connected to a liquid supply reservoir (not illustrated), in particular a supply reservoir for a liquid displacement medium.

Advantageously, the liquid displacement medium is a high-density liquid medium. Particularly advantageously, the high-density liquid medium includes monoethylene glycol, MEG.

Figure 3:
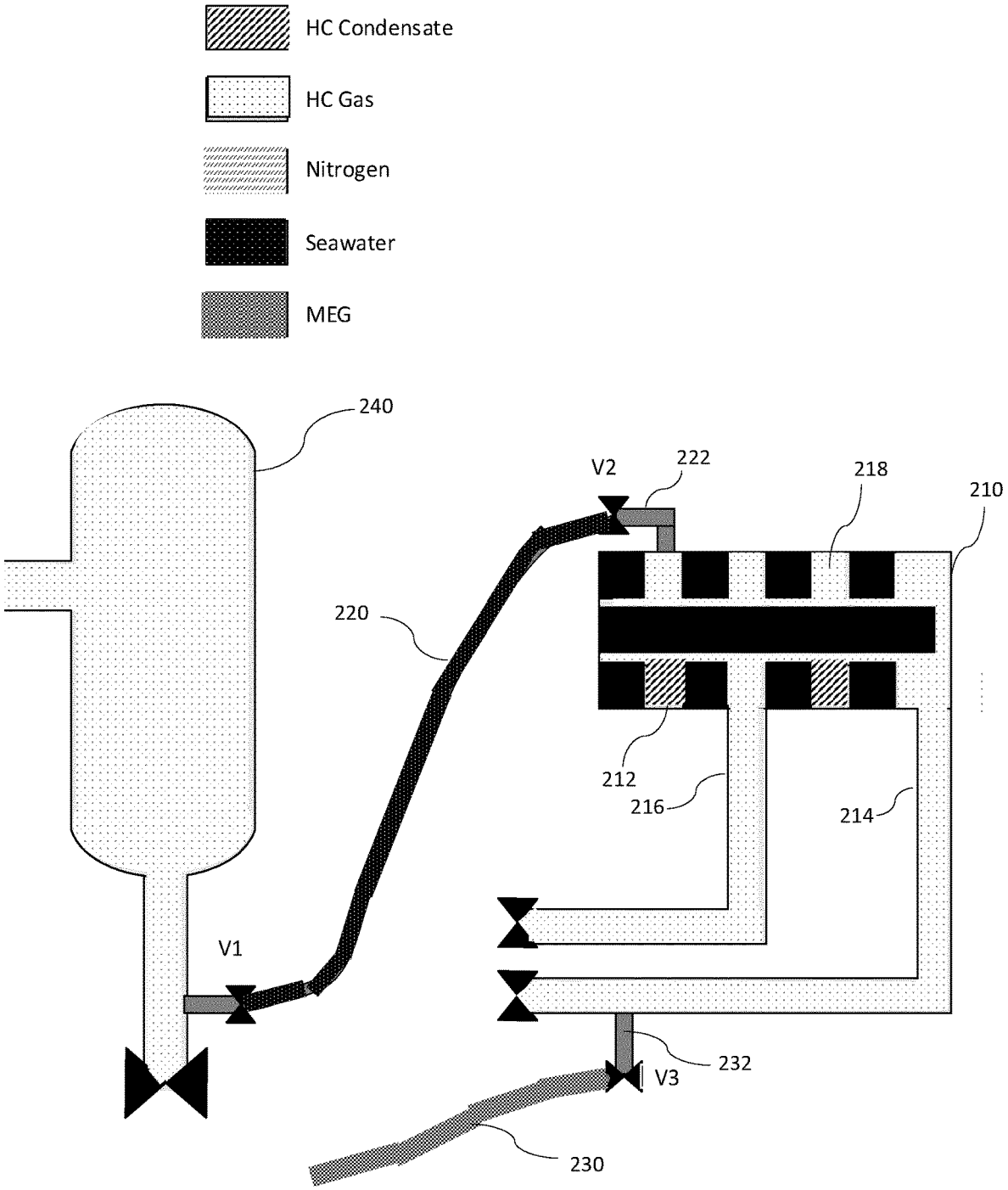
FIG. 3 is a schematic diagram illustrating principles of a first stage of evacuating hydrocarbon from the subsea process module.

The situation after the connection of the receiving container line 220 and the liquid adding line 230 is illustrated in FIG. 3.

Next, in step 130, hydrocarbon is displaced by the liquid displacement medium added through the liquid adding line 230. This may be effectuated by opening of the valve V3.

Advantageously, the step of displacing the hydrocarbon initially contained in the subsea process module 210 may firstly include displacing preferably all the liquid-phase portion of the hydrocarbon by the liquid displacement medium. In particular, if using MEG, condensate is lighter than MEG and condensate contained in low-points prior to step 130 will float on top of MEG and thus be displaced through the upper fluid connection point 222. Secondly, the step of displacing the hydrocarbon initially contained may comprise displacing all hydrocarbon gas which is not trapped in high-point pockets.

Figure 4:
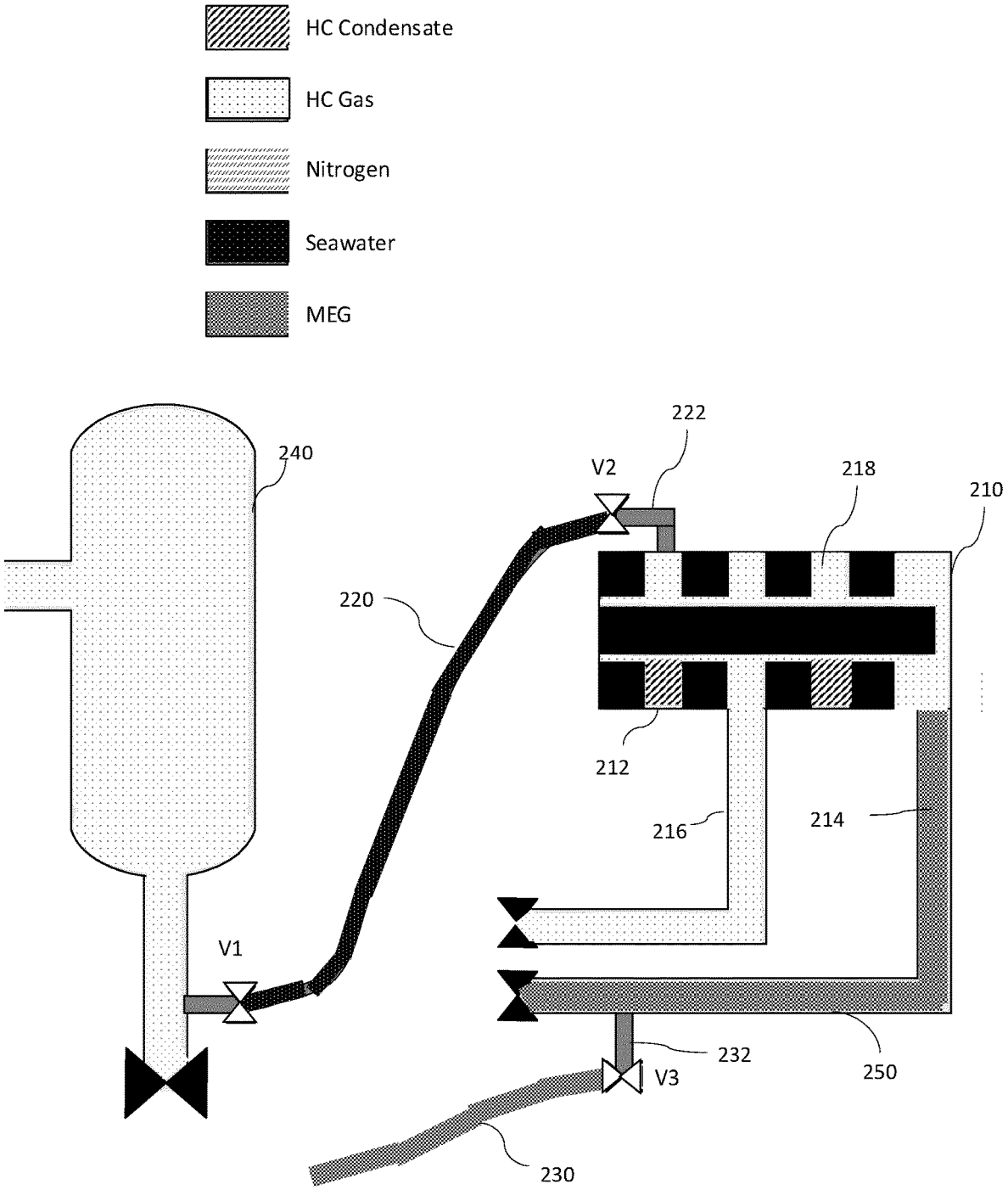
FIG. 4 is a schematic diagram illustrating principles of a second stage of evacuating hydrocarbon from the subsea process module.

A first situation during the displacing step 130 is illustrated in FIG. 4. In FIG. 4, the liquid displacement medium has filled a first flowline 214 of the subsea process module 210, as illustrated at 250.

Advantageously, the displacing step 130 includes transferring/displacing fluid from the subsea process module 210 to the external container 240. The transferring of fluid from the subsea process module 210 to the external container 240 may be effectuated by opening valves V2 and V1. The receiving container line 220 may contain seawater. In case internals of process module 210 is not compatible with seawater, entering of seawater into process module 210 should be prevented by awaiting opening of valve V2 and/or valve V1 until an overpressure of process module 210 versus container 240 is established. Hence, advantageously the sequence 130 starts by filling a displacement fluid, and when a pre-defined overpressure (e.g. 2-5 bar) is obtained, valves V1 and V2 are opened to allow transferring of fluid. The pressure difference measurements may be provided from suitable pressure sensors arranged within the subsea process module 210 and the external container 240, respectively.

Figure 5:
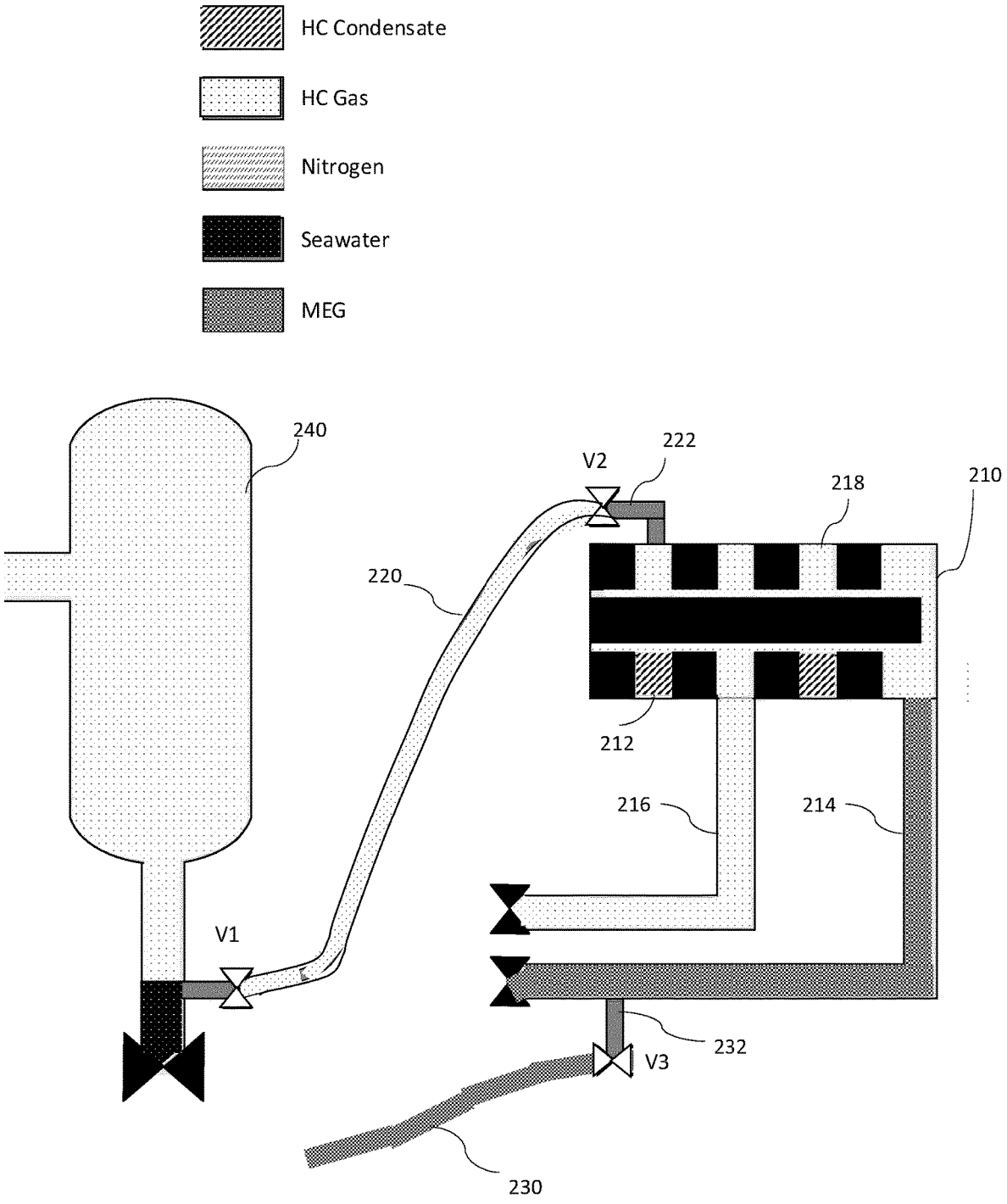
FIG. 5 is a schematic diagram illustrating principles of a third stage of evacuating hydrocarbon from the subsea process module.

A second situation during the displacing step 130 is illustrated in FIG. 5. In FIG. 5, seawater that may initially have been included in the receiving container line 220 is displaced through valve V1 to the external container 240.

Advantageously, the displacing step 130 is continued until a first predetermined condition is met. Particularly advantageously, the first predetermined condition is met when a measured amount of liquid displacement medium exceeds a predetermined limit. To determine if the first predetermined condition is met, it may be necessary to measure the amount of liquid displacement medium.

Advantageously, the displacing step 130 includes transferring fluid from the subsea process module 210 to the external container 240. One is certain that the process module 210 is filled with displacement liquid and hence that all gas has been removed (except the gas trapped in high points) by measuring that the liquid level in the external container 240 starts to increase. Thereafter, hydrocarbon liquid (condensate) is transferred to the external container 240. Most of the condensate is removed when the amount of liquid displaced to the external container 240 exceeds maximum potential condensate volume in the process module 210 in step 100. The displacement volume to the external container 240 can be measured either by:

1) measuring a liquid level increase in the external container 240 using a liquid level sensor, or
2) measuring the amount of added displacement fluid (e.g. MEG) by using e.g. a flow meter in the supply system. When the added amount is larger than the volume of the process volume 210, one knows that the hydrocarbon (gas and condensate) within the whole volume of the process module 210 (except non-ventilated high-points) has been displaced.

The predetermined level limit should correspond to a transferred volume larger than the largest possible volume of liquid in process module 210 at the initial step 100, and hence ensuring that all hydrocarbon liquids are transferred in step 130.

In either case, the amount of liquid displacement medium transferred to the external container, corresponding to the predetermined level limit, should exceed the internal volume of the subsea process module 210. This will ensure that the subsea process module 210 is filled with liquid displacement medium to its maximum possible extent at the terminating of the displacing step 130, and hence that hydrocarbon and condensate is to the maximum possible extent displaced to the external container 240.

Figure 6:
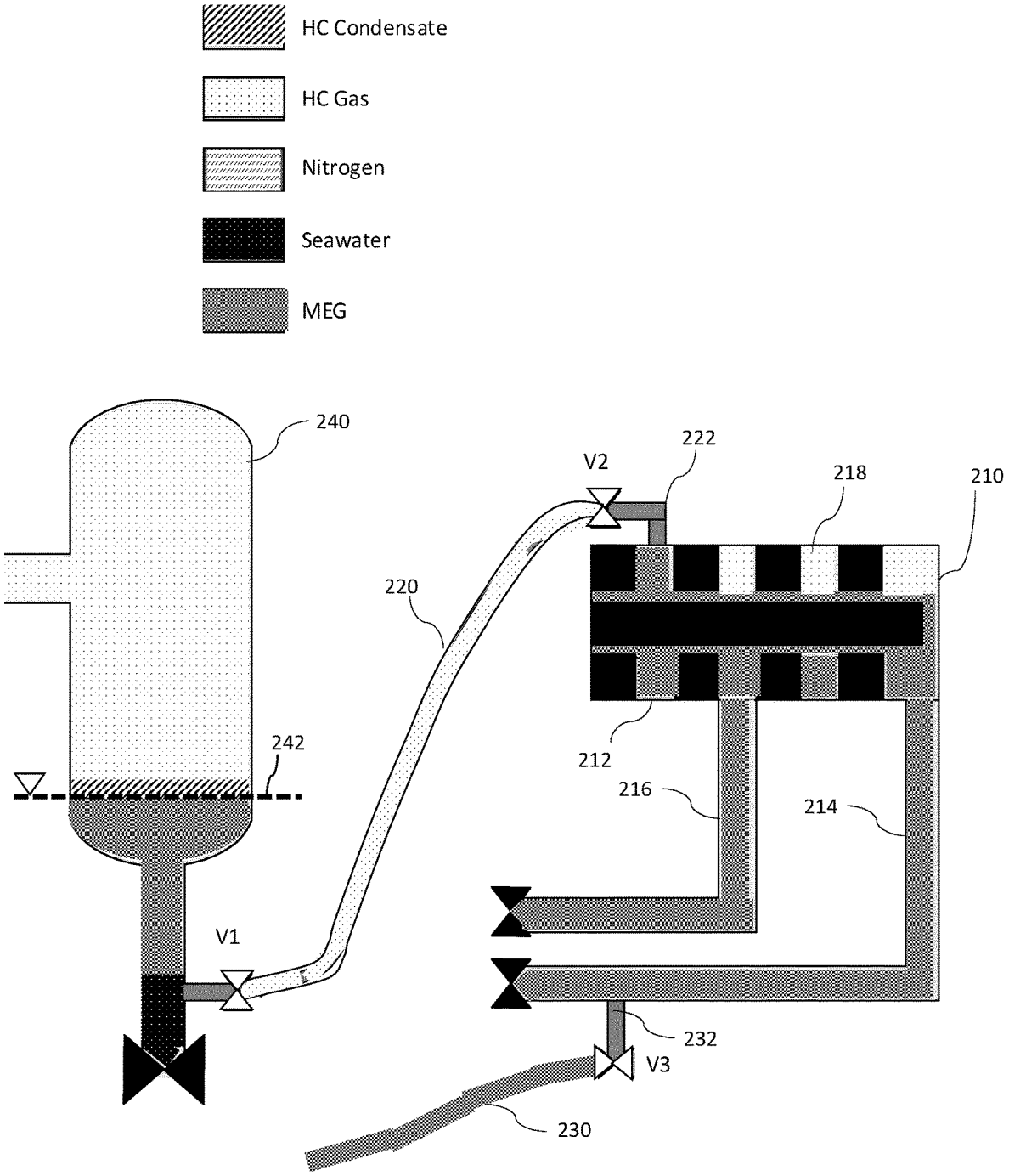
FIG. 6 is a schematic diagram illustrating principles of a fourth stage of evacuating hydrocarbon from the subsea process module.

FIG. 6 illustrates a situation at a point of time corresponding to the terminating of the displacing step 130, i.e., when the first predetermined condition is met. In FIG. 6, the liquid level (i.e. the level of MEG indicated at reference 242 in the external container 240), has been determined to exceed the predetermined level limit, and the supply of displacement medium may be terminated by closing the valve V3.

Next, in step 140, the liquid adding line 230 is removed from the lower fluid connection point 232 of the subsea processing module 210. Next, in step 150, the receiving container line 220 is connected to the lower fluid connection point 232 of the subsea processing module 210. Alternatively, the receiving container line 220 can be connected to another lower fluid connection point (not shown) which is in fluid communication with the inner volume of process module 210.

Subsequently, in step 160, a gas adding line 260 is connected to the upper fluid connection point 222 of the subsea processing module. Although not shown, in the event that there are more upper and/or lower fluid connection points, this gas adding line 260 may alternatively be connected to another available connection point.

Figure 7:
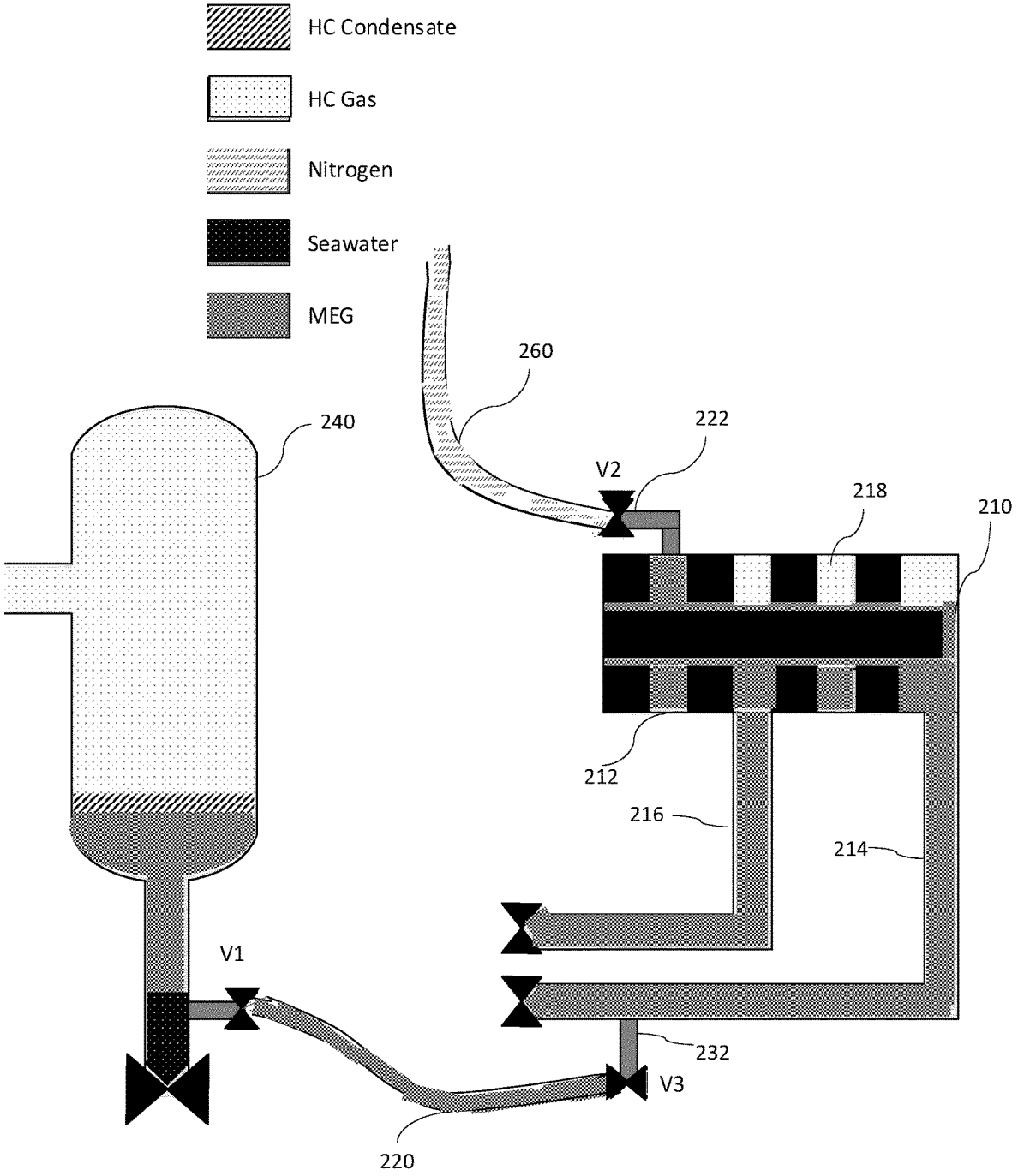
FIG. 7 is a schematic diagram illustrating principles of a fifth stage of evacuating hydrocarbon from the subsea process module.

FIG. 7 illustrates the situation after the removal of the liquid adding line 230 from the lower fluid connection point 232 in step 130, the connection of the receiving container line 220 to the lower fluid connection point 232 in step 140, and the connection of a gas adding line 260 to the upper fluid connection point 222 in step 160.

Next, in step 170, the remaining hydrocarbon included in the subsea processing module 210 is diluted by a gas medium. Advantageously, the gas medium is an inert, non-hazardous gas, for example nitrogen, $N_2$.

Advantageously, the diluting step 170 of diluting the remaining hydrocarbon by a gas medium includes diluting a gas-phase portion of the hydrocarbon initially contained in the subsea processing module 210 that has been trapped in a gas pocket 218, i.e., a cavity directed upwards, in the subsea process module 210.

Advantageously, the diluting step 170 is continued until a second predetermined condition is met. The second predetermined condition may, e.g. be fulfilled when all liquid (i.e. MEG if MEG is used as displacement liquid), other than liquid trapped in low points, is displaced to external container 240. This can be detected by level readings in external container 240, or by measuring the supplied volume of dilution medium.

Figure 8:
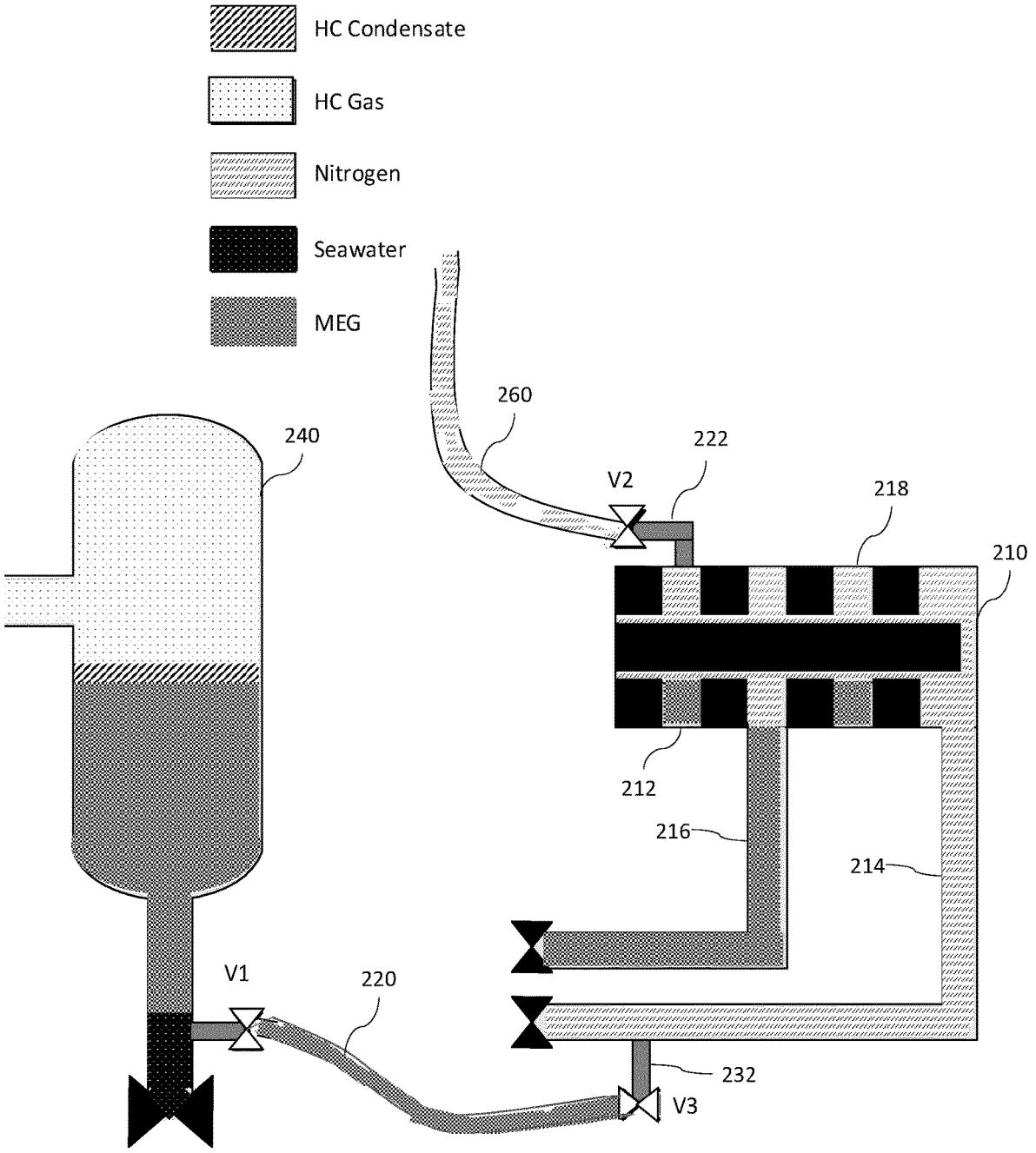
FIG. 8 is a schematic diagram illustrating principles of a sixth stage of evacuating hydrocarbon from the subsea process module.

FIG. 8 is a schematic diagram illustrating a principle of a sixth stage of evacuating hydrocarbon from the subsea process module. FIG. 8 illustrates a possible situation after the termination of step 170. The gas adding line 260 has been connected to a gas supply, such as a $N_2$ supply, all valves V1, V2 and V3 are opened. The displacement liquid contained in the subsea processing module 210 has been displaced to the external container 240, except the MEG that is trapped in both of the low-points 212 after dilution. Valve V3 may be closed, the gas medium may be depressurized in the subsea processing module 210, valve V2 may be closed. The receiving container line 220 and gas adding line 260 may then be disconnected from the subsea processing module 210.

After completion of the diluting step 170, hydrocarbon is completely or at least sufficiently evacuated from the subsea processing module 210, and the subsea processing module 210 can safely be retrieved from the subsea location.

The steps of the disclosed method that involve physically manipulating connection lines or hoses, opening and closing valves etc., may advantageously be performed by means of a remotely operated vehicle, ROV. Steps involving operation of valves may alternatively or in addition be performed by electric or hydraulic actuators that may be remotely or automatically controlled by appropriate, interconnected control means.

The invention has now been explained with reference to non-limiting embodiments. However, a skilled person will understand that there may be made alternations and modifications to the embodiment that are within the scope of the invention as defined in the attached claims.

The invention claimed is:

1. A method for evacuating hydrocarbons from a number of pockets within a subsea process module, the subsea process module having a number of upper fluid connection points and a number of lower fluid connection points, the method comprising:

connecting a receiving container line to one of said upper fluid connection points of the subsea process module;

connecting a liquid adding line to one of said lower fluid connection points of the subsea process module;

displacing hydrocarbon from the subsea process module through the receiving container line by adding a liquid displacement medium through the liquid adding line;

removing the liquid adding line from said one of said lower fluid connection points;

connecting a gas adding line to one of said upper fluid connection points or one of said lower fluid connection points;

connecting the receiving container line to one of said lower fluid connection points; and adding a gas medium through the gas adding line to thereby dilute a gas-phase portion of the hydrocarbon that has been trapped in at least one of said pockets within the subsea process module.

2. The method according to claim 1, wherein the subsea process module is a subsea compressor module.

3. The method according to claim 1, wherein the liquid displacement medium is a high-density liquid medium.

4. The method according to claim 3, wherein the high-density liquid medium includes monoethylene glycol (MEG).

5. The method according to claim 1, wherein the gas medium is nitrogen.

6. The method according to claim 1, wherein the step of displacing the hydrocarbon includes displacing a liquid-phase portion of the hydrocarbon.

7. The method according to claim 1, wherein the displacing step includes transferring fluid from the subsea process module to an external container connected to the receiving container line.

8. The method according to claim 7, wherein the external container is a flow conditioning unit.

9. The method according to claim 1, wherein the displacing step is continued until a first predetermined condition is met.

10. The method according to claim 9, wherein the first predetermined condition is met when a measured amount of liquid displacement medium exceeds a predetermined limit.

11. The method according to claim 9, wherein the displacing step includes transferring fluid from the subsea process module to an external container connected to the receiving container line, and wherein the first predefined condition is met when a liquid level in the external container exceeds a predetermined level limit.

12. The method according to claim 1, wherein the diluting step is continued until a second predetermined condition is met.

13. The method according to claim 1, further comprising, subsequent to the diluting step, retrieving the subsea process module from a subsea location.

* * * * *